US008172957B2

(12) United States Patent
Sakaue et al.

(10) Patent No.: US 8,172,957 B2
(45) Date of Patent: May 8, 2012

(54) METHOD OF MANUFACTURING CARBURIZED PARTS

(75) Inventors: Hideyuki Sakaue, Aichi-gun (JP); Koji Inagaki, Toyota (JP); Masahiko Mitsubayashi, Nagoya (JP); Takuya Shimizu, Seto (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/203,587

(22) PCT Filed: Sep. 9, 2010

(86) PCT No.: PCT/JP2010/065544

§ 371 (c)(1),
(2), (4) Date: Aug. 26, 2011

(87) PCT Pub. No.: WO2012/032637

PCT Pub. Date: Mar. 15, 2012

(65) Prior Publication Data

US 2012/0060977 A1 Mar. 15, 2012

(51) Int. Cl.
*C23C 8/20* (2006.01)

(52) U.S. Cl. ..... 148/210; 148/211

(58) Field of Classification Search ..... 148/210, 148/206, 211

See application file for complete search history.

(56) References Cited

U.S. PATENT DOCUMENTS

| | | | | | |
|---|---|---|---|---|---|
| 4,303,137 | A | * | 12/1981 | Fischer | 175/374 |
| 4,798,077 | A | * | 1/1989 | Douglas | 72/360 |
| 5,975,223 | A | * | 11/1999 | Karlsson | 175/374 |
| 6,237,441 | B1 | * | 5/2001 | Nishioka et al. | 74/569 |
| 6,655,026 | B1 | * | 12/2003 | Iida et al. | 29/888.09 |

FOREIGN PATENT DOCUMENTS

| | | | |
|---|---|---|---|
| JP | 61-186166 | A | 8/1986 |
| JP | 09-302454 | * | 11/1997 |
| JP | 11-269540 | A | 10/1999 |
| JP | 11-302821 | A | 11/1999 |
| JP | 2000-074324 | A | 3/2000 |
| JP | 2000-096132 | A | 4/2000 |
| JP | 2004-244673 | A | 9/2004 |
| JP | 2007-302969 | A | 11/2007 |

OTHER PUBLICATIONS

Machine translation of JP 09-302454 (published Nov. 1997).*
International Search Report of PCT/JP2010/065544 issued Nov. 16, 2010.
Written Opinion of PCT/JP2010/065544 issued Nov. 16, 2010 and English translation thereof.

* cited by examiner

*Primary Examiner* — Jonathan Johnson
(74) *Attorney, Agent, or Firm* — Kenyon & Kenyon LLP

(57) ABSTRACT

To provide a method of manufacturing a carburized part contributable to cost reduction, a portion intended for a non-carburizing portion is treated to a surface roughness corresponding to Rz 50 like a first work surface and a portion intended for a carburizing portion is treated to a surface roughness corresponding to Rz 1.5 like a second work surface.

6 Claims, 4 Drawing Sheets

METHOD OF MANUFACTURING CARBURIZED PARTS

CROSS-REFERENCE TO RELATED APPLICATIONS

This is a 371 national phase application of PCT/JP2010/065544 filed on 9 Sep. 2010, the entire contents of which are incorporated herein by reference.

TECHNICAL FIELD

The present invention relates to a technique of manufacturing a carburized part by providing different surface roughnesses for different portions of the carburized part to prevent carburizing thereof.

BACKGROUND ART

A steel part or component constituting machinery includes many friction portions and thus is demanded in many cases to have abrasion resistance. A technique of carburizing the surface of a steel part or component to improve abrasion resistance is also used for parts or components constituting a vehicle. Actually, the parts subjected to the carburizing treatment are used throughout a vehicle.

Carburizing an entire part can enhance the surface hardness of the part but may cause problems in which machining is difficult, breakages or cracks are apt to occur during welding, and others. Therefore, there is a demand to partially carburize only a desired portion. Various studies have accordingly been made to obtain a part in which a non-carburizing portion needing no carburizing is not carburized.

Patent Document 1 discloses a technique of suppressing and preventing carburizing and metal dusting. The surface of a metal member to be exposed to high-temperature carbon gas is plastic-deformed or plastic-strained in advance. This can control a carburizing depth in the carburizing treatment. This makes it possible to restrain a phenomenon in which metals and alloys disintegrate or decompose into dust in a carburizing atmosphere called metal dusting and the dust is blown off by a gas flow or the like, forming pits or causing abrasion wastage.

Patent Document 2 discloses a technique of preventing carburizing of a welded portion. Considering circumstances that carburizing occurs in a welded joint, a first layer is welded to a base material and then a silicon-containing material is coated or stacked to a back side of the base material. This is reacted or fused (melted) by use of welding heat for second and subsequent layers, thus forming an oxide coat made of silica dioxide. This method can form the oxide coat, thereby preventing carburizing of the welded portion.

Patent Document 3 discloses a technique of a carburizing inhibiting material. A copper alloy coat is formed in a portion in which a screw part is to be formed. Thereby, the carburizing of the relevant portion is prevented during subsequent carburizing of a part.

Patent Document 4 discloses a technique of preventing carburizing in a carburizing treatment. A tin coat is formed as a mask member on a portion desired to avoid carburizing, thereby preventing carburizing of the relevant portion.

Patent Document 5 discloses a technique of preventing carburizing. On a portion desired to avoid carburizing, two or more kinds of carburizing inhibiting agents containing a first substance and a second substance is applied. The first substance is a substance, such as boric acid and boron oxide, that can be sequentially melted in a temperature range from a first temperature to a treating temperature, thereby sequentially coating the metal surface. The second substance is a substance, such as a mixture of rubber and an adhesive material, that can be melted in a temperature range from a normal temperature to at least the first temperature, thereby coating the metal surface. By such application of the carburizing preventing agent during a carburizing treatment, it is possible to prevent the carburizing treatment.

RELATED ART DOCUMENTS

Patent Documents

Patent Document 1: JP 11(1999)-269540 A
Patent Document 2: JP 61(1986)-186166 A
Patent Document 3: JP 2007-302969 A
Patent Document 4: JP 11(1999)-302821 A
Patent Document 5: JP 2000-096132 A

DISCLOSURE OF THE INVENTION

Problems to be Solved by the Invention

However, Patent Documents 1 to 5 may cause the problems explained below.

In recent years, there is an increasing demand for cost reduction in vehicles. For even parts needing a carburizing treatment, a manufacturing method thereof is demanded to be reconsidered for reduction in cost. However, the methods disclosed in Patent Documents 2 to 5, in which the coats are formed in advance in the non-carburizing portions prior to the carburizing treatment require an additional process of removing the coats after the carburizing treatment. As the number of working process steps increases, the part costs will increase.

The method disclosed in Patent Document 1 also likely needs a plastic deformation process or a plastic-strain applying process to the non-carburizing portion before the carburizing treatment. This needs a processing cost. In many cases, portions to be formed as non-carburizing portions are considered to need no particular mechanical accuracy. In such case, the plastic-deformation process or the plastic-strain applying process has to be conducted only for preventing the carburizing treatment. Accordingly, cost will be increased.

The applicant has studied improvement of the carburizing treatment method to shorten the time required for the carburizing treatment. However, the conventional methods shown in Patent Documents 1 to 5 needing an increase in working process step to restrain the carburizing portion could shorten the time required for the carburizing treatment but need a long lead time for making the non-carburizing portions. This brings an undesirable result that increases costs.

The present invention has been made to solve the above problems and has a purpose to provide a method of manufacturing a carburized part which can contribute to cost reduction.

Means of Solving the Problems

To achieve the above purpose, one aspect of the invention provides the following configurations.

(1) A method of manufacturing a carburized part by carburizing a metal part including a carburizing portion to be carburized and a non-carburizing portion in which carburizing is to be restrained is characterized in that a work surface of a portion to be formed as the non-carburizing portion is made rougher in surface roughness than a work surface of a portion to be formed as the carburizing portion.

(2) In the method of manufacturing the carburized part described in (1), preferably, the surface roughness of the work surface of the non-carburizing portion is set to at least Rz 50 or more.

(3) In the method of manufacturing the carburized part described in (2), preferably, the portion to be formed as the non-carburizing portion is a portion to be welded after the carburizing treatment.

(4) In the method of manufacturing the carburized part described in (1) or (2), preferably, the non-carburizing portion is a portion to be machined after the carburizing treatment.

EFFECTS OF THE INVENTION

The method of manufacturing the carburized part according to one aspect of the invention configured as above can provide the following operations and advantages.

The aspect of the invention described in (1) is a method of manufacturing a carburized part by carburizing a metal part including a carburizing portion to be carburized and a non-carburizing portion in which carburizing is to be restrained, wherein a work surface of a portion to be formed as the non-carburizing portion is made rougher in surface roughness than a work surface of a portion to be formed as the carburizing portion.

Since the work surface roughness of the portion to be formed as the non-carburizing portion is made rougher, excess carburizing is likely caused in the non-carburizing portion by the edge effect and carbide is apt to occur in the surface of the non-carburizing portion. Thus, after the carbide is formed, further carburizing is prevented in the non-carburizing portion.

As a result, a portion of the non-carburizing portion far from the surface can be placed in an environment in which carburizing less occurs. It is therefore possible to make the carburized part easy to machine after the carburizing treatment or prevent the occurrence of cracks during welding. Consequently, the surface treatments as disclosed in Patent Documents 1 to 5 are not needed and thus the working process can be shortened.

According to the aspect of the invention described in (2), in the carburized part manufacturing method in (1), the surface roughness of the work surface of the non-carburizing portion is set to at least Rz 50 or more. From the findings by the applicant, the edge effect disclose in (1) can be estimated when the non-carburizing portion is formed with the surface roughness of about Rz 50. If the surface roughness is about Rz 50, it is possible to restrain carburizing in the non-carburizing portion by an easy method.

According to the aspect of the invention described in (3), in the carburized part manufacturing method in (1) or (2), the portion to be formed as the non-carburizing portion is a portion to be welded after the carburizing treatment. Since the welded portion is formed as the non-carburizing portion, it is possible to prevent the occurrence of weld cracks and improve the weldability. When a portion intended to be welded is carburized and the content of carbon increases in a base material, the ductibility of the base material is apt to lower, leading to the occurrence of weld cracks during welding. In contrast, since the non-carburizing portion is formed with about Rz 50, carburizing of a portion to be welded later can be prevented and thus weld cracks can be avoided. Further, the rough surface roughness leads to improvement of weldability.

According to the aspect of the invention described in (4), in the carburized part manufacturing method in (1) or (2), the non-carburizing portion is a portion to be machined after the carburizing treatment.

Since the portion to be machined after the carburizing treatment is formed as the non-carburizing portion, the carburizing of the non-carburizing portion can be restrained to maintain machinability. Increasing of carbon in a base material causes deterioration of machinability. It is therefore undesirable to carburize the portion to be machined later. In contrast, the portion to be machined later is formed as the non-carburizing portion, so that machinability can be maintained.

MODE FOR CARRYING OUT THE INVENTION

A detailed description of a first preferred embodiment of the present invention will now be given referring to the accompanying drawings.

Figure 1:
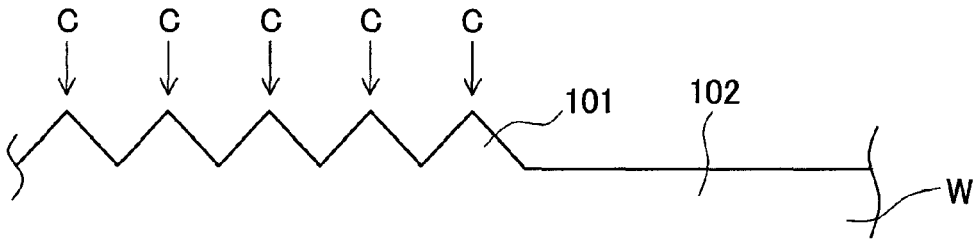
FIG. 1 is a cross sectional view showing a state before a carburizing treatment in a first embodiment.
Figure 2:
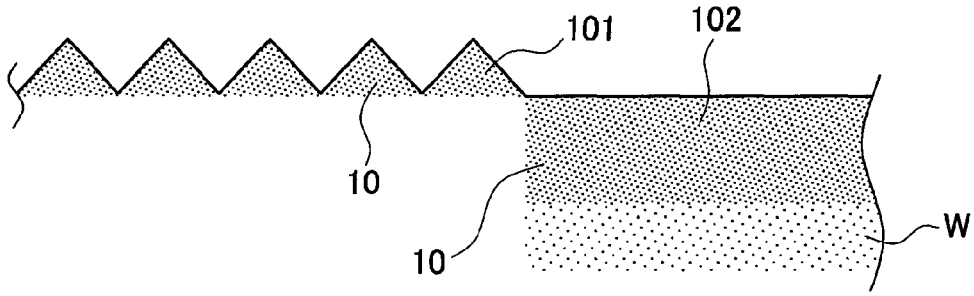
FIG. 2 is a cross sectional view showing a state after the carburizing treatment in the first embodiment.
Figure 3:
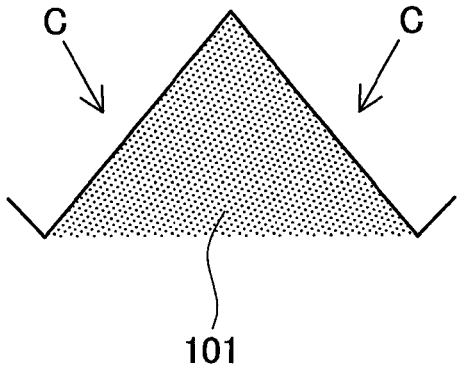
FIG. 3 is an enlarged view showing the state after the carburizing treatment in the first embodiment.
Figure 4:
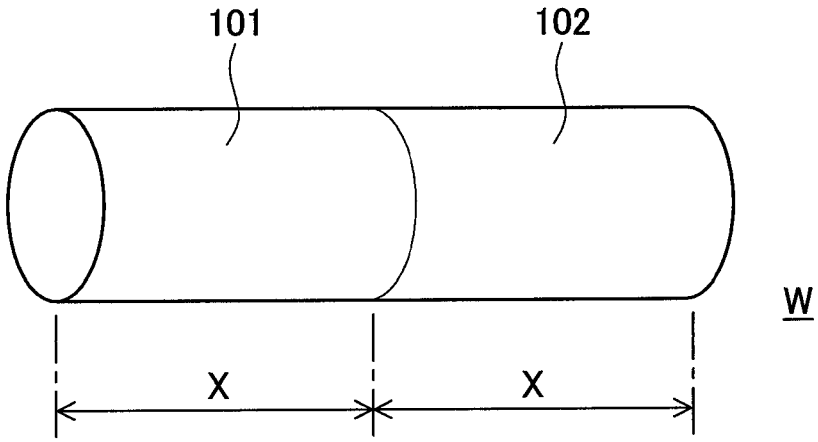
FIG. 4 is a perspective view of a work in the first embodiment.

FIG. 1 is a cross sectional view showing a state of a work before a carburizing treatment in the first embodiment. FIG. 2 is a cross sectional view showing a state of the work before the carburizing treatment. FIG. 3 is an enlarged cross sectional view of FIG. 2. FIG. 4 is a perspective view of a work (workpiece) W.

The work W is a steel part to be used as machine parts. The work W shown in FIG. 4 is designed as a shaft having a simple shape. Such work W is put in a vacuum furnace and subjected to a carburizing treatment, thereby increasing a carbon content in the surface of the work W to improve abrasion resistance. The work W is a cylindrical shaft as shown in FIG. 4, including a first work surface 101 and a second work surface 102 having the same length X in an axial direction of the work W. The work W is shown in a simple shape for convenience of explanation, but may take any other complicated shapes.

The cross section of the work W is shown in enlarged form in FIGS. 1 and 2, in which the first work surface 101 is made rougher in surface roughness than the second work surface 102. The first work surface 101 is a non-carburizing portion and the second work surface 102 is a carburizing portion that has to be subjected later to a carburizing treatment. The surface roughness in the first embodiment is set so that the first work surface 101 is Rz (Ten-point mean roughness) 50 and the second work surface 102 is Rz 1.5. The first work surface 101 is a surface processed to such a degree as obtained by machining such as lathing and pressing. The second work surface 102 is formed by grinding.

In actual measurements, the first work surface 101 has Rz (Ten-point mean roughness) 52.0 μm and Ra (Center line mean roughness) 12.6 μm (a measurement length is 12.5 mm). The second work surface 102 has Rz 1.4 μm and Ra 0.16 μm (a measurement length is 3.2 mm).

Figure 5:
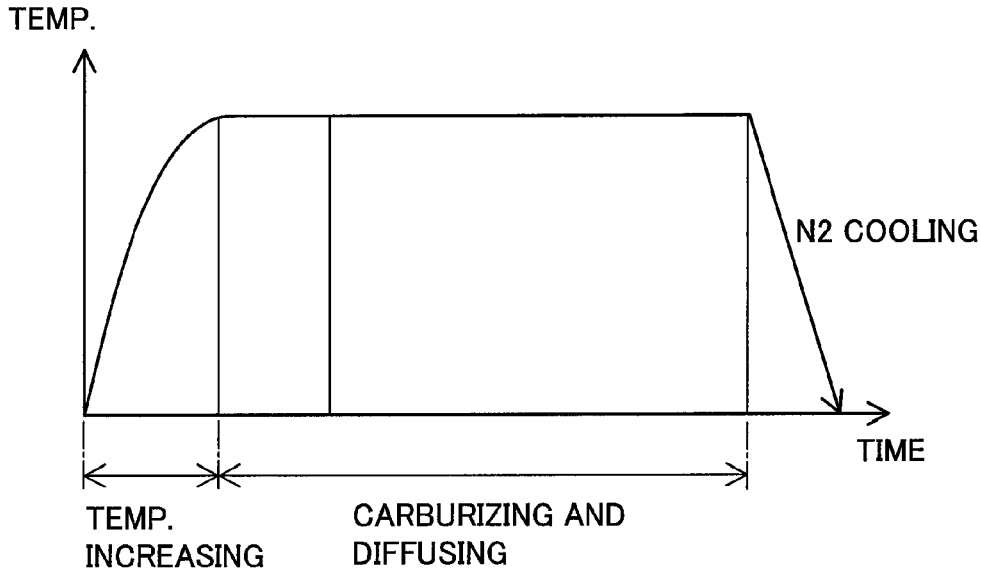
FIG. 5 is a diagram showing a process of the carburizing treatment in the first embodiment.

FIG. 5 is a diagram showing a carburizing treatment. A vertical axis represents the temperature and a horizontal axis represents the time. For carburizing the work W, the carburizing treatment is conducted by a "temperature increasing step", a "carburizing and diffusing step", and an "$N_2$ cooling step".

In the "temperature increasing step", the work W is put in a furnace. The furnace is evacuated to form a vacuum therein and the work W is heated. In the "carburizing and diffusing step", acetylene ($C_2H_2$) gas to be used as carburizing gas C is filled in the furnace so that the surface of the work W is exposed to the carburizing gas C, thereby causing carbon to penetrate into the work W. The carburizing treatment using acetylene gas is known to be effective as a method of shortening a treating time as disclosed in for example JP 2008-223060A and others. The "$N_2$ cooling step" is a step of spraying nitrogen onto the work W to cool the work W. The use of nitrogen enables gas quench, thereby accelerating the cooling of the work W. Through the above process, the carburized work W is obtained.

Figure 6:
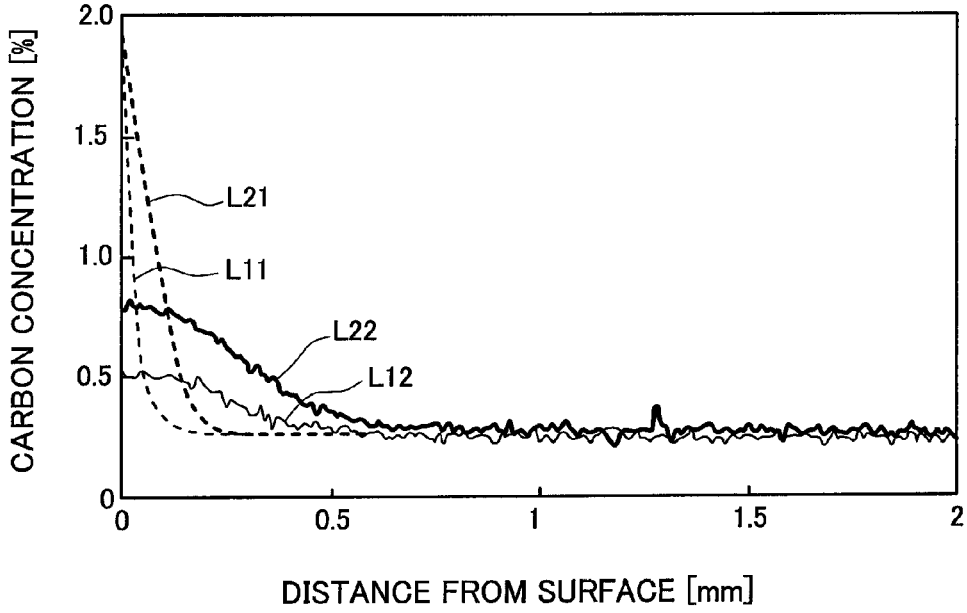
FIG. 6 is a graph showing carburizing depths in a work in the first embodiment.

FIG. 6 is a graph showing carburizing depths in the work W. A vertical axis represents the carbon concentration and a horizontal axis represents the distance from the surface of the work W.

A first carbon concentration curve L11 is an imaginary line showing a state of the first work surface 101 just after the start of the carburizing treatment to the work W. A second carbon concentration curve L2 is an imaginary line showing a state of the second work surface 102 just after the start of the carburizing treatment to the work W. A first after-cooling concentration curve L12 shows a result of measurement of concentration of the first work surface 101 after the work W passes through the "$N_2$ cooling step" of the carburizing treatment.

A second after-cooling concentration curve L22 shows a measurement result of the carbon concentration of the second work surface 102 after the work W undergoes the "$N_2$ cooling step" of the carburizing treatment. The carbon concentration is measured by EPMA analysis. In the case where the work W is subjected to the carburizing treatment, the first work surface 101 and the second carburizing 102 are different in carbon content as shown in FIG. 6.

Specifically, the first carbon concentration curve L11 and the second carbon concentration curve L21 are almost equal in carbon concentration on the surfaces. However, as the distance from the surface is longer, the carbon concentration of the first carbon concentration curve L11 is lower at a faster rate than that of the second carbon concentration curve L21. The carbon concentration does not fall below a constant value because a base material itself of the work W contains carbon.

Comparing between the first after-cooling concentration curve L12 and the second after-cooling concentration curve L22, the first after-cooling concentration curve L12 is lower in the carbon concentration itself on the surface than the second after-cooling concentration curve L22. It is also found that the first after-cooling concentration curve L12 is also lower in the total carbon content itself than the second after-cooling concentration curve L22.

Changing from the first carbon concentration curve L11 to the first after-cooling concentration curve L12 and changing from the second carbon concentration curve L21 to the second after-cooling concentration curve L22 are caused by diffusion of carbon into the work W.

The carburized part manufacturing method in the first embodiment configured as above can provide the operations and advantages described below.

A first advantage is to restrain carburizing in the non-carburizing portion at low cost.

Specifically, a portion desired to be the non-carburizing portion is made with a surface roughness of Rz 50 or more like the first work surface 101 and a portion desired to be the carburizing portion is made with a surface roughness corresponding to Rz 1.5 like the second work surface 102. Accordingly, the carburizing depth can be shallower in the first work surface 101 than in the second work surface 102 as shown in FIGS. 5 and 6.

Consequently, the surface area of the first work surface 101 exposed to the carburizing gas C becomes wider as shown in FIG. 3. This configuration likely causes excess carburizing due to an edge effect and hence carbide (cementite structure) is easy to generate on the surface. This tendency more prominently appears as shortening of the carburizing time is advanced.

Accordingly, the carbide is generated in the surface portion of the first work surface 101 by excess carburizing, so that carburizing reaction rapidly decreases. To be concrete, carbon is concentrated in protrusions of the first work surface 101 as shown in FIG. 3, causing excess carburizing in the protrusions and hence forming carbide. When the carbide is formed in the surface, the carbon is prevented from diffusing into the base material. As a result, a portion far from the surface of the first work surface 101 can be placed in an environment in which carburizing is unlikely to occur. It is therefore possible to make the work W easy to treat after the carburizing treatment and further prevent the occurrence of cracks during welding.

Since the cementite structure is a brittle and hard structure and thus the tenacity or toughness lowers, a normal carburizing treatment is conducted without actively precipitating carbide. However, according to the present invention, carbide is generated at an earlier stage of the "carburizing and diffusing step", so that carburizing in a portion far from the surface can be prevented.

Since the surface roughness of the non-carburizing portion is made rough like the first work surface 101, it is possible to restrain the carburizing. With such configuration, unlike the method of forming a coat in advance to form the non-carburizing portion, it is unnecessary to form the coat before the carburizing treatment and remove the coat after the carburizing treatment. Consequently, the working process can be shortened.

A second embodiment of the present invention will be explained below.

The second embodiment is substantially the same in structure as the first embodiment, excepting a non-carburizing portion. This different configuration is explained below.

Figure 7:
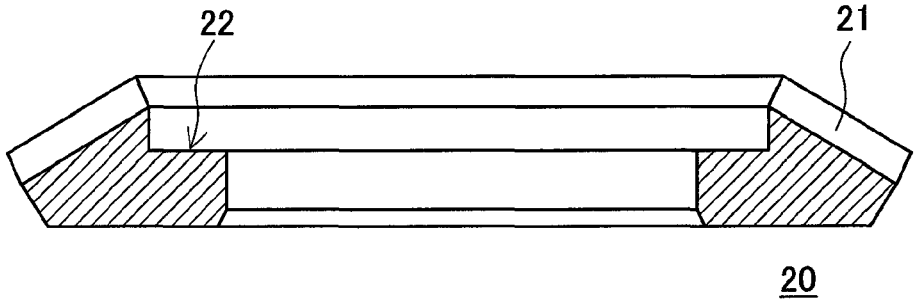
FIG. 7 is a cross sectional view of a bevel gear which is a work in a second embodiment.

FIG. 7 shows the shape of a work in the second embodiment. The work in the second embodiment is a bevel gear 20 including teeth 21 and an inner-circumferential annular portion ("annular portion") 22. The teeth 21 are subjected to the carburizing treatment, while the annular portion 22 is connected to a part or component not shown by welding. Accordingly, the teeth 21 are formed with the surface roughness equivalent to Rz 1.5 and the annular portion 22 is formed with the surface roughness equivalent to Rz 50. The bevel gear 20 in this state is put in a carburizing furnace not shown for conducting the carburizing treatment.

The second embodiment configured as above can provide the operations and advantages described below.

In the gear, it is desired that the teeth 21 needing higher abrasion resistance is a carburizing portion and the annular portion 22 to be subjected to welding is a non-carburizing portion. This configuration is similarly necessary for a spur gear and other gears. Specifically, the teeth need the abrasion resistance, while the inner circumferential portion is preferred to have a lesser carbon content in internal structure in order to prevent the occurrence of cracks during welding.

When a welded portion is clamped by the surroundings during welding, weld cracks are generated when it exceeds ductibility of a welding-heat affected zone due to heat distortion resulting from welding. When a carburized layer is formed by the carburizing treatment, ductibility lowers and hence weld cracks are likely to occur due to welding. However, when the annular portion 22 is made to have a surface roughness of Rz 50, carburizing of the annular portion 22 can be prevented during the carburizing treatment. This can prevent the occurrence of weld cracks. Further, since the annular portion 22 is designed to be rough with the surface roughness of about Rz 50, it also can contribute to improvement of weldability.

A third embodiment of the invention will be explained below.

The third embodiment is substantially the same in structure as the first embodiment, excepting a non-carburizing portion. This different point is explained below.

Figure 8:
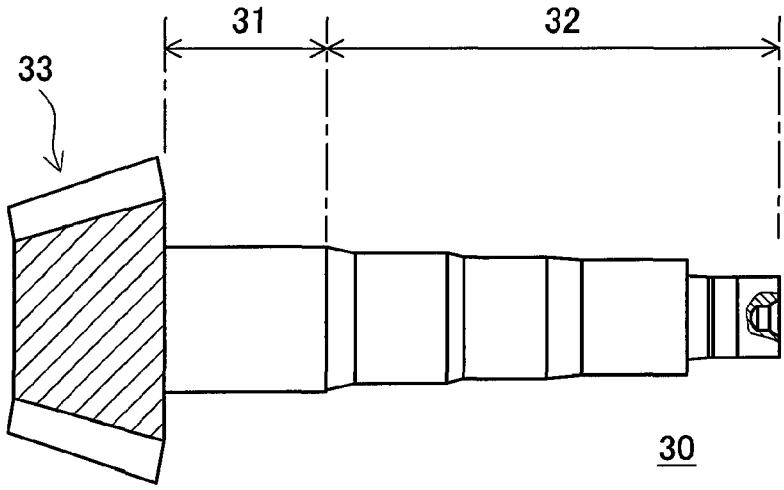
FIG. 8 is a partial cross sectional view of a shaft which is a work in a third embodiment.

FIG. 8 shows the shape of a work in the third embodiment. The work in the third embodiment is a shaft 30 with a bevel gear, including a first stepped shaft portion 31, a second stepped shaft portion 32, and a gear portion 33.

The first shaft portion 31 is a portion to be machined after carburizing and has a surface roughness of Rz 50 before carburizing. The second shaft portion 32 is a portion not to be machined after carburizing and has a surface roughness of Rz 1.5. The gear portion 33 is also to be subjected to the carburizing work and has a surface roughness of Rz 1.5.

After the carburizing treatment, the carbon content in the material of a work increases, hardening a work surface. This deteriorates machinability of the work. However, since the surface roughness of the first shaft portion 31 to be subjected to machining after the carburizing treatment is set to Rz 50, a carburized portion is in only a shallow superficial layer as shown in FIGS. 2 and 6. This prevents the base material of the first shaft portion 31 from containing carbon and thus avoids deterioration of machinability thereof.

Then, the first shaft portion 31 is machined after the carburizing, leading to shortening of the working process of the shaft 30. The first shaft portion 31 needs no carburizing treatment but requires machining accuracy. In this case, the carburizing treatment may cause deformation or distortion of the material, thus resulting in deterioration in machining accuracy. Therefore, cutting and grinding have to be performed again after the carburizing treatment.

However, since the first shaft portion 31 made rough with the surface roughness of about Rz 50 is subjected to the carburizing treatment, the carburizing depth can be made shallow. As a result, omission of a treatment before the carburizing treatment can improve machinability after the carburizing treatment. In other words, the working process can be shortened. Consequently, the processing cost of the shaft 30 can be reduced.

The invention is not limited to the above embodiments but may be embodied in other specific forms without departing from the essential characteristics thereof.

For instance, the present invention can be applied to any shapes of works other than the works shown in the first to third embodiments. Further, the work surface roughness may be any surface roughness defined not only by the ten-point mean roughness but also by other evaluation methods. The surface roughness may also be set to be lower than Rz 1.5 to provide a smooth surface.

Description Of The Reference Signs

21 Teeth
22 Inner circumferential annular portion
30 Shaft
31 First stepped shaft portion
32 Second stepped shaft portion
33 Gear portion
101 First work surface
102 Second work surface
C Carburizing gas
L11 First carbon concentration curve
L12 First after-cooling concentration curve
L21 Second carbon concentration curve
L22 Second after-cooling concentration curve
W Workpiece

The invention claimed is:

1. A method of manufacturing a carburized part by carburizing a metal part including a carburizing portion to be carburized and a non-carburizing portion in which carburizing is to be restrained, wherein a work surface of a portion to be formed as the non-carburizing portion is made rougher in surface roughness than a work surface of a portion to be formed as the carburizing portion.

2. The method of manufacturing a carburized part according to claim 1, wherein the surface roughness of the work surface of the non-carburizing portion is set to at least Rz 50 or more.

3. The method of manufacturing a carburized part according to claim 1, wherein the portion to be formed as the non-carburizing portion is a portion to be welded after the carburizing treatment.

4. The method of manufacturing a carburized part according to claim 1, wherein the non-carburizing portion is a portion to be machined after the carburizing treatment.

5. The method of manufacturing a carburized part according to claim 2, wherein the portion to be formed as the non-carburizing portion is a portion to be welded after the carburizing treatment.

6. The method of manufacturing a carburized part according to claim 2, wherein the non-carburizing portion is a portion to be machined after the carburizing treatment.

* * * * *